United States Patent [19]

Capuano et al.

[11] Patent Number: 4,542,008

[45] Date of Patent: Sep. 17, 1985

[54] ELECTROCHEMICAL CHLORINE DIOXIDE PROCESS

[75] Inventors: Italo A. Capuano, Orange; Diane L. DeFelice, North Haven, both of Conn.

[73] Assignee: Olin Corporation, Cheshire, Conn.

[21] Appl. No.: 538,713

[22] Filed: Oct. 3, 1983

[51] Int. Cl.[4] ..... C01B 11/02

[52] U.S. Cl. ..... 423/477; 204/101; 422/68

[58] Field of Search ..... 423/477; 204/101; 422/68

[56] References Cited

U.S. PATENT DOCUMENTS

| | | | |
|---|---|---|---|
| 3,586,484 | 6/1971 | Anderson | 422/68 |
| 3,763,006 | 10/1973 | Callerame | 423/477 |
| 4,066,362 | 1/1978 | Carter | 422/68 |
| 4,432,856 | 2/1984 | Murakami et al. | 204/237 |

FOREIGN PATENT DOCUMENTS

| | | | |
|---|---|---|---|
| 2412394 | 12/1974 | Fed. Rep. of Germany | 204/101 |

*Primary Examiner*—William R. Dixon, Jr.
*Assistant Examiner*—Steven Capella
*Attorney, Agent, or Firm*—James B. Haglind; Donald F. Clements

[57] ABSTRACT

A continuous process for the production of chlorine dioxide by the electrolysis of an aqueous solution of sodium chlorite is provided. The process comprises electrolyzing the aqueous sodium chlorite solution to produce chlorine dioxide which dissolves to produce an aqueous solution of $NaClO_2$ containing chlorine dioxide. The aqueous solution of sodium chlorite-containing $ClO_2$ is passed through a photometric cell to measure the chlorite ion concentration as a function of the color produced by the $ClO_2$-$NaClO_2$-$H_2O$ system. Chlorine dioxide gas is removed from the aqueous solution and recovered.

The novel process of the present invention employs solutions containing low, accurately controlled concentrations of sodium chlorite ion which when electrolyzed avoid the formation of by-products such as a dark colored chlorine dioxide complex and sodium chlorate.

13 Claims, 2 Drawing Figures

ELECTROCHEMICAL CHLORINE DIOXIDE PROCESS

The present invention relates to the production of chlorine dioxide. More particularly, the invention relates to the electrolytic production of chlorine dioxide gas. Chlorine dioxide is commercially employed as a bleaching agent and sanitizing agent.

The electrochemical production of chlorine dioxide has been described previously, for example, by J. O. Logan in U.S. Pat. No. 2,163,793, issued June 27, 1939. The process electrolyzes solutions of an alkali metal chlorite such as sodium chlorite containing an alkali metal chloride or alkaline earth metal chloride as an additional electrolyte for improving the conductivity of the solution. The process preferably electrolyzes concentrated chlorite solutions to produce chlorine dioxide in the anode compartment of an electrolytic cell having a porous diaphragm between the anode and cathode compartments.

British Pat. No. 714,828, published Sept. 1, 1954, by Farbenfabriken Bayer, teaches a process for electrolyzing an aqueous solution containing a chlorite and a water soluble salt of an inorganic oxy-acid other than sulfuric acid. Suitable salts include sodium nitrate, sodium nitride, sodium phosphate, sodium chlorate, sodium perchlorate, sodium carbonate, and sodium acetate.

A process for producing chlorine dioxide by the electrolysis of a chlorite in the presence of a water soluble metal sulfate is taught by M. Rempel in U.S. Pat. No. 2,717,237, issued Sept. 6, 1955.

Japanese Pat. No. 1866, published Mar. 16, 1956, by S. Saito et al (C.A. 51, 6404, 1957) teaches the use of a cylindrical electrolytic cell for chlorite solutions having a porcelain separator between the anode and the cathode. Air is used to strip the $ClO_2$ from the anolyte solution.

Japanese Pat. No. 4569, published June 11, 1958, by S. Kiyohara et al (C.A. 53, 14789d, 1959) teaches the use of a pair of membrane cells, in the first of which a concentrated $NaClO_2$ solution is electrolyzed in the anode compartment. Air is used to strip the $ClO_2$ from the anolyte which is then fed to the cathode compartment of the second cell. NaOH, produced in the cathode compartment of the first cell, is employed as the anolyte in the second cell.

A process for producing chlorine dioxide by the electrolysis of an aqueous solution of lithium chlorite is taught in U.S. Pat. No. 3,763,006, issued Oct. 2, 1973, to M. L. Callerame. The chlorite solution is produced by the reaction of sodium chlorate and perchloric acid and a source of lithium ion such as lithium chloride. The electrolytic cell employed a semi-permeable membrane between the anode compartment and the cathode compartment.

Japanese Disclosure No. 81-158883, disclosed Dec. 7, 1981, by M. Murakami et al describes an electrolytic process for producing chlorine dioxide by admixing a chlorite solution with the catholyte solution of a diaphragm or membrane cell to maintain the pH within the range of from 4 to 7 and electrolyzing the mixture in the anode compartment. The electrolyzed solution, at a pH of 2 or less, is then fed to a stripping tank where air is introduced to recover the chlorine dioxide.

In the above processes, chlorine dioxide gas produced dissolves readily to provide a solution containing chlorine dioxide and chlorite. As the chlorite ion concentrations are high, a portion of the chlorine dioxide present in the solution reacts with chlorite ion to produce an undesirable complex as a by-product according to the following equation:

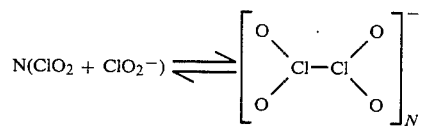

(1)

The complex is dark mahogany in color and decomposes by the reactions of Equations (2) and (3).

$$N(Cl_2O_4)^- \longrightarrow Cl^- + 3ClO_3^- + Cl_2O_3 \quad (2)$$

(complex)

$$Cl_2O_3 \longrightarrow Cl_2 + 1.5\ O_2 \quad (3)$$

Where technical grade sodium chlorite is used to produce chlorine dioxide, sufficient amounts of sodium hydroxide are present to provide a solution which is strongly basic. Basic solutions result in the reaction of chlorine dioxide with sodium hydroxide to produce sodium chlorate as an undesirable by-product according to the following equation:

$$2ClO_2 + 2NaOH \rightarrow NaClO_2 + NaClO_3 + H_2O \quad (4)$$

Therefore a process for electrolytically producing chlorine dioxide gas is needed which minimizes side reactions of chlorine dioxide which reduce the product yield while forming undesired by-products.

It is an object of the present invention to provide a process for producing chlorine dioxide which minimizes side reactions and by-product formation.

Another object of the present invention is to provide a process for producing chlorine dioxide by the electrolysis of an aqueous solution having controlled concentrations of sodium chlorite.

These and other objects of the present invention are accomplished in a continuous process for the production of chlorine dioxide by the electrolysis of an aqueous solution of sodium chlorite which comprises:

(a) feeding an aqueous solution of sodium chlorite to the anode compartment of an electrolytic cell;

(b) electrolyzing the aqueous solution of sodium chlorite in the anode compartment of an electrolytic cell to produce an aqueous solution of sodium chlorite containing dissolved chlorine dioxide;

(c) removing said aqueous solution of sodium chlorite containing dissolved chlorine dioxide from the anode compartment;

(d) passing said aqueous solution of sodium chlorite containing dissolved chlorine dioxide through a photometric cell to measure the chlorite ion concentration; and (e) recovering chlorine dioxide gas from said aqueous solution.

Figure 1:
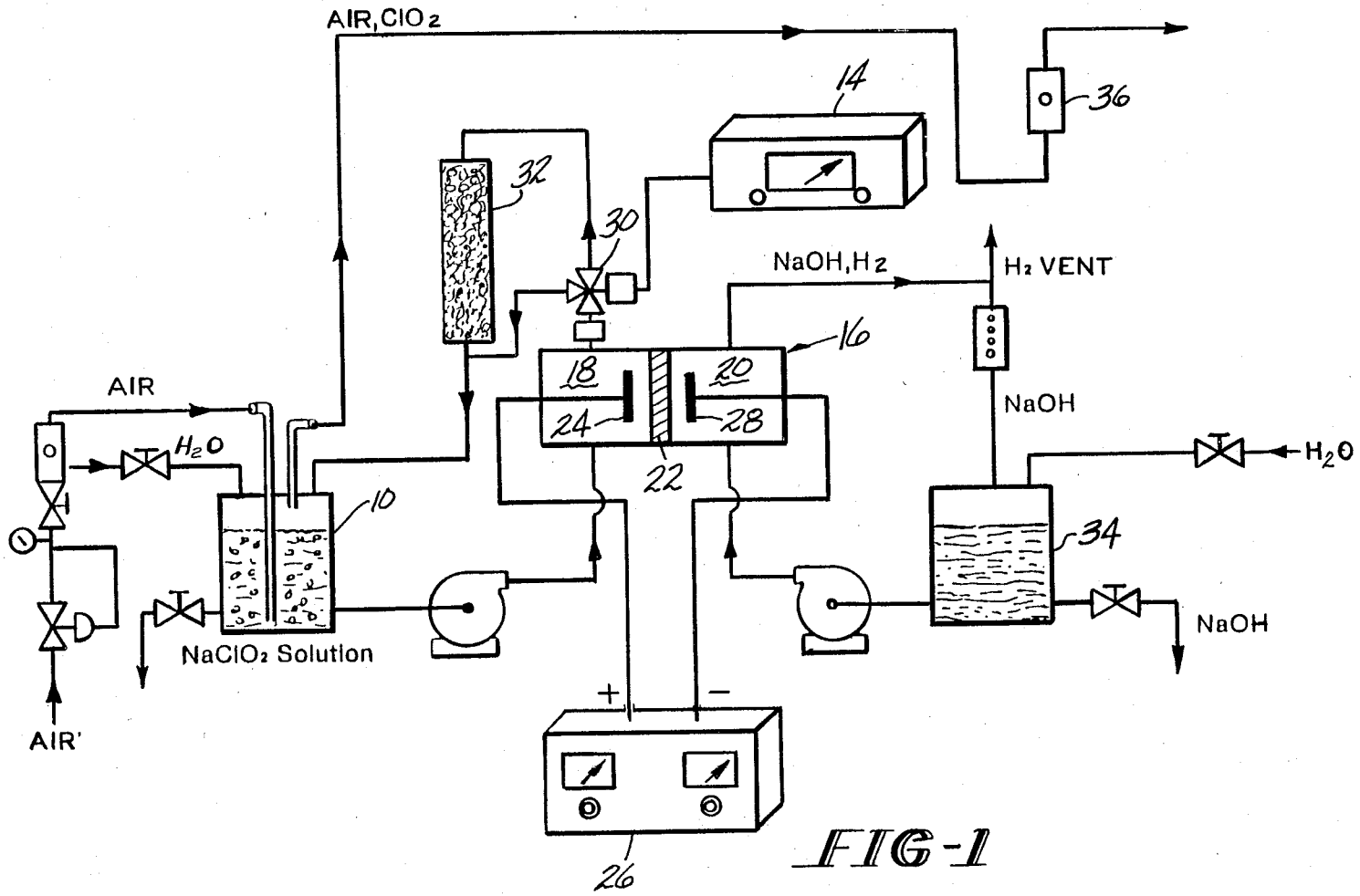
FIG. 1 is a flow sheet illustrating the novel electrolytic process of the present invention.

In the process of FIG. 1, sodium chlorite solution, contained in tank 10, is pumped to anode compartment 18 of electrolytic cell 16. Electrolytic cell 16 is comprised of anode compartment 18 containing anode 24, and cathode compartment 20 containing cathode 28, separated by membrane 22. Anode 24 receives electric current from D.C. power source 26 and passes current through the chlorite solution to cathode 28 to produce chlorine dioxide at anode 24 and hydrogen gas and sodium hydroxide solution at cathode 28. A sodium chlorite solution containing dissolved chlorine dioxide is removed from anode compartment 18 and passed through photoelectric cell 12. Photoelectric cell 12 measures the concentration of chlorite ion of the solution and records the measurement on photometer 14. When the concentration of chlorite ion in the sodium chlorite solution is above a predetermined upper limit, as determined by photometer 14, valve 30 is operated to return the chlorine dioxide-containing chlorite solution to tank 10. When the concentration of chlorite ion is below the predetermined upper limit, the chlorine-dioxide containing chlorite solution passes through valve 30 to resaturation column 32. Resaturation column 32 contains particles of sodium chlorite, a portion of which dissolve in the chlorine dioxide-containing chlorite solution to provide the desired chlorite ion concentration as determined by the photometer. The resaturated chlorite solution is returned to tank 10. The level of sodium chlorite solution in tank 10 may be controlled by a level controller (not shown) which also permits the addition of water to tank 10 when required. To recover chlorine dioxide gas from the chlorine dioxide-containing chlorite solution, an inert gas such as air is passed through the solution to produce a chlorine dioxide gaseous mixture which is removed from tank 10. The chlorine dioxide gaseous mixture is passed through monitor 36 which measures the concentration of $ClO_2$.

Sodium hydroxide solution and hydrogen gas produced during the electrolysis are removed from cathode compartment 20. The hydrogen gas may be vented or, where suitable volumes are produced, dried and used, for example, as a fuel. The concentrated sodium hydroxide solution is conveyed to storage vessel 34. If desired, water may be added to storage vessel 34 to dilute the concentrated sodium hydroxide solution. NaOH solution may be recycled to the cathode compartment 20 of electrolytic cell 16.

More in detail, the novel process of the present invention electrolyzes an aqueous solution of sodium chlorite to produce a solution of chlorine dioxide. To prevent the formation of the complex

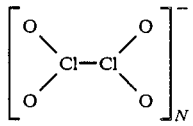

as described above, the concentration of sodium chlorite in the aqueous solution is maintained within the range of from about 0.8 to about 5.0, preferably from about 1 to about 3 percent, and more preferably from about 1 to about 2 percent by weight. Control of the concentration is provided by passing the sodium chlorite solution containing dissolved chlorine dioxide through a concentration measuring device which measures the visible light transmission of the aqueous chlorite-chlorine dioxide solution. One suitable device is a photometer which records the visible light transmitted through the sodium chlorite solution containing dissolved $ClO_2$ as it passes by a photometric cell. The sodium chlorite solution containing dissolved $ClO_2$ having the desired concentration range of chlorite ion is normally yellow in color, but begins to darken as the chlorite ion concentration increases. The darkening of the solution is evidence of the formation of the dark mahogany complex discussed above.

The photometric cell as used in the present specification includes, for example, barrier layer cells and photoelectric tubes which are commonly employed in photoelectric photometers.

Figure 2:
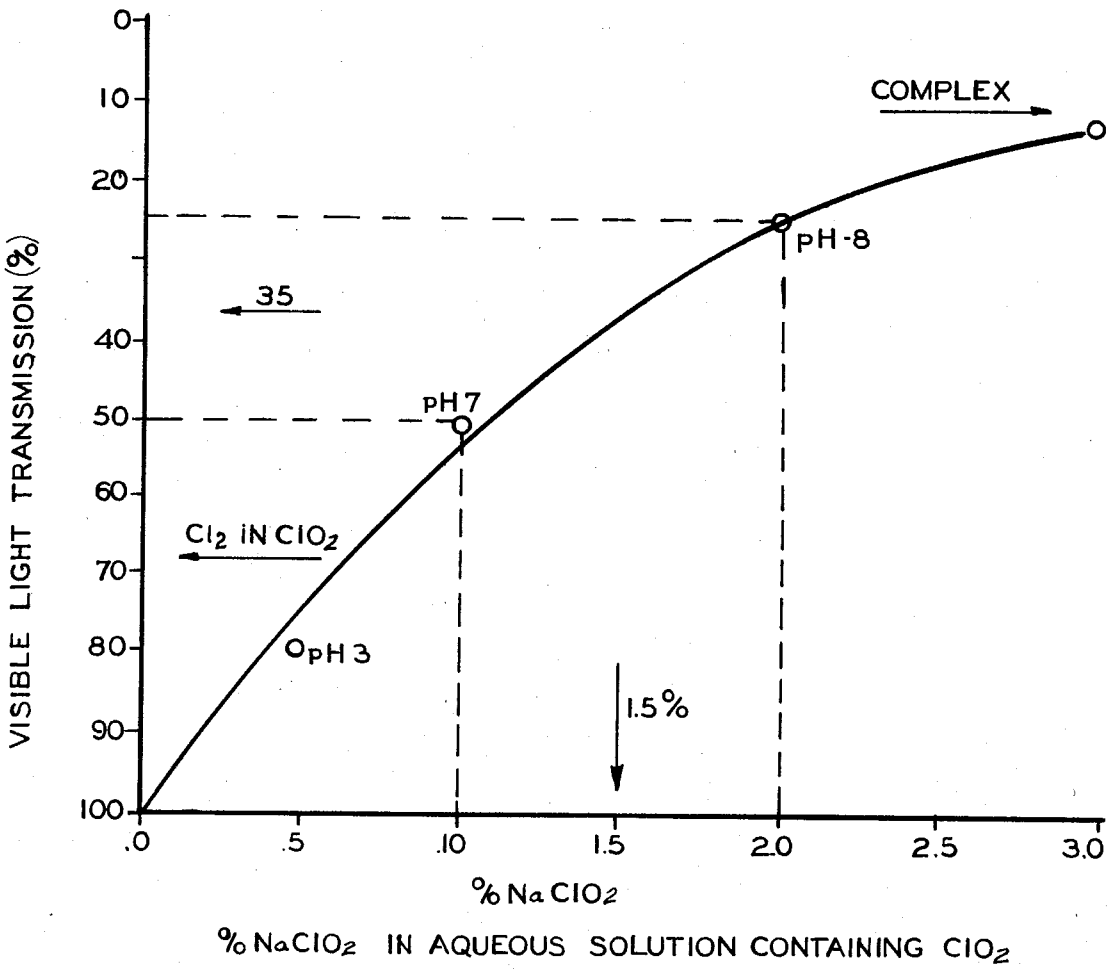
FIG. 2 is a graph depicting the relationship between light transmission and the $NaClO_2$ concentrations of aqueous sodium chlorite solutions containing dissolved $ClO_2$.

Sodium chlorite solutions containing dissolved $ClO_2$ having the desired low chlorite ion concentrations have visible light transmissions in the range of from about 10 to about 60, and preferably from about 25 to about 50 percent, as shown in FIG. 2.

While FIG. 1 shows photoelectric cell 12 positioned between anode compartment 18 and valve 30, it may be positioned between tank 10 and anode compartment 18, if desired.

Any suitable electrolytic cell design may be employed for the electrolysis of the $NaClO_2$ solution which has an anode compartment separated from the cathode compartment by a cation exchange membrane. Cation exchange membranes which can be employed are inert, flexible membranes, which are substantially impervious to the hydrodynamic flow of the chlorite electrolyte and the passage of gas products produced in the cell. Suitably used, for example, are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid group" are meant to include salts of sulfonic acid or salts of carboxylic acid which are suitably converted to or from the acid groups by processes such as hydrolysis. Suitable cation exchange membranes are sold commercially by E. I. DuPont de Nemours and Company under the trademark "Nafion"; by the Asahi Glass Company under the trademark "Flemion"; and by the Asahi Chemical Company under the trademark "Aciplex".

Anodes suitable for use in the electrolytic membrane cell employed in the process of the present invention include those of carbon or graphite. Also suitable are those of a valve metal such as titanium or tantalum having an electrochemically active coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium, and iridium. Coatings containing mixtures of valve metal oxides such as titanium oxides and platinum group metal oxides such as ruthenium oxide are described in U.S. Pat. No. 3,632,498 issued to H. B. Beer on Jan. 4, 1972. Other anodes which may be employed include those described in U.S. Pat. Nos. 4,333,805, issued June 8, 1982, to C. R. Davidson et al; 4,240,887, issued Dec. 23, 1980, to D. E. Hall; 4,200,515, issued Apr. 29, 1980, to D. E. Hall et al; 4,042.484, issued Aug. 16, 1977, to G. Thiele et al; 3,962,068, issued June 8, 1976, to D. Zoellner et al; and 3,992,280, issued Nov 16, 1976, to C. Zoellner et al.

Suitable cathodes employed in the electrolytic process of the present invention include those of carbon or graphite as well as metal electrode structures in the form of a screen, mesh, perforated plate or expanded metal. Examples of suitable metals include iron and iron alloys including steel as well as metals having a low hydrogen overvoltage such as nickel or cobalt. Low hydrogen overvoltage cathodes have at least one catalytically active surface including, for example, porous surfaces such as those of a Raney metal (e.g. nickel or cobalt). Cathodes which can be employed in the novel cell of the present invention include those, for example, described in U.S. Pat Nos. 4,116,804, issued Sept. 26, 1978, to C. Needes; 4,184,941, issued Jan. 28, 1980, to W. W. Carlin; 4,248,680, issued Feb. 3, 1981, to W. W. Carlin et al; 4,135,995, issued June 23, 1979, to C. N. Welch; 4,224,121, issued Sept. 23, 1980, to R. W. Dempsey et al; and 4,033,837, issued July 5, 1977, to H. C. Kuo et al.

One preferred cathode embodiment comprises a Raney metal alloy surface layer integral with and derived from a selected nickel alloy monolithic substrate structure. The surface layer is predominantly derived from an adherent crystalline precursor outer portion thereon comprising $Ni_xM_{1-x}Al_3$ Beta phase structure where M is a catalytic activator and where x, the fraction of nickel in the combined weight of Ni and M, is up to about 0.95.

As the catalytic activator, M is preferably molybdenum. However, it should be understood that the use of molybdenum is merely illustrative and that it may be replaced in whole or in part by ruthenium, titanium, tantalum, or mixtures thereof. X is preferably within the range of 0.80 to about 0.95. These cathodes are disclosed by T. J. Gray in U.S. Pat. Nos. 4,240,895, issued Dec. 23, 1980; 4,289,650, issued Sept. 15, 1981; and 4,384,932, issued May 24, 1983.

While cathodes of carbon or graphite or steel are preferably spaced apart from the membrane, cathodes having catalytic coatings may be placed in contact with or imbedded in the membrane.

Electrolysis of the sodium chlorite solution in the electrolytic membrane cell takes place at current densities in the range of from about 0.5 to about 10, and preferably from about 1 to about 5 kiloamps per square meter. Chlorine dioxide produced at the anode dissolves in the chlorite anolyte to provide the solution with a yellow color. A portion of the anolyte is removed from the cell, preferably continuously, and passed through photoelectric cell 12. Where the concentration of the sodium chlorite in solution prior to electrolysis is measured to be above about 3 percent by weight, the chlorite solution is fed directly to a tank or the solution reservoir.

Where the sodium chlorite concentration is at or below about 3 percent by weight, sodium chlorite is added to resaturate the chlorine dioxide containing solution. This can be accomplished by adding a $NaClO_2$ solution or by passing the chlorine dioxide-containing solution removed from the electrolytic cell through a resaturator, for example, a cartridge column or bed of granular sodium chlorite particles. The resaturator contains sodium chlorite in particle forms which permit the easy flow of solution through the resaturator without a substantial drop in pressure to produce resaturated solutions having accurately controlled chlorite concentrations. Suitable particle forms of $NaClO_2$ include tablets, briquettes and the like.

Chlorine dioxide gas is recovered from the aqueous sodium chlorite solution. Any suitable recovery method may be used including, for example, passing an inert gas such as air, nitrogen, carbon dioxide, helium or argon through the solution. A gaseous mixture containing $ClO_2$ is then recovered.

To prevent the formation of an explosive mixture of, for example, chlorine dioxide in air, in one embodiment, the gaseous mixture is passed through a monitoring device such as a redox cell or a gas chromatograph. The chlorine dioxide concentration is measured and, when above a predetermined limit, an alarm is set off. In a preferred embodiment, the $ClO_2$ measuring device is also connected to DC power source 26 and when the pre-determined limit is reached, the power is shut off and electrolytic production of $ClO_2$ in electrolytic cell 16 is discontinued. While $Cl0_2$-air mixtures containing up to about 16 percent by volume $ClO_2$ may be considered safe, it is preferred to maintain the $ClO_2$ concentrations at about 10 percent or less.

Commercially produced sodium chlorite used as a reactant in the novel process of the present invention may contain sodium hydroxide as an impurity in concentrations sufficient to make an aqueous solution prepared from it sufficiently basic so that the pH is above 8, for example, at about 11. At pHs above about 8, the sodium hydroxide present in the solution reacts with chlorine dioxide produced according to the following equation:

$$2ClO_2 + 2NaOH \rightarrow NaClO_2 + NaClO_3 + H_2O \quad (4)$$

While it is known to add sodium chloride to the sodium chlorite solution electrolyte, in the processes of the prior art, these processes produce chlorine dioxide in $NaClO_2$ solutions having chlorite ion concentrations which result in the formation of the complex discussed above. At the low concentrations of $NaClO_2$ employed in the process of the present invention, a portion of the NaCl is electrolyzed and the following reactions occur at the anode:

$$2NaCl \xrightarrow{2H_2O} Cl_2 + 2NaOH + H_2 \quad (5)$$

$$2NaClO_2 + Cl_2 \longrightarrow 2ClO_2 + 2NaCl \quad (6)$$

$$Cl_2 + H_2O \longrightarrow HCl + HOCl \quad (7)$$

$$NaOH + HCl \longrightarrow NaCl + H_2O \quad (8)$$

These reactions take place without the formation of the undesired $ClO_2$–$ClO_2^-$ complex. The sodium chlorite solution electrolyzed is yellow in color and has a pH in the range of from about 5 to about 8, preferably from about 7 to about 8. If the sodium chlorite solution contains less than about 0.8 percent of $NaClO_2$ by weight, the pH of the solution drops significantly, as shown in FIG. 2, because of HCl formation and chlorine is present in the chlorine dioxide gas produced. Within the $NaClO_2$ concentrations employed in the process of the present invention, chlorine dioxide gas is generated which is free of chlorine and in the absence of the chlorine dioxide complex.

The electrochemical process of the present invention produces chlorine dioxide gas which is free of chlorine. The process employs conditions which minimize by-product formation including the chlorine dioxide complex present in the process of the prior art by accurately controlling the concentration of $NaClO_2$ in the electrolyte. Chlorine dioxide gas produced may be used directly for treating, for example, water including waste water, potable water, cooling water in air conditioning systems, and in food processing plants.

The following EXAMPLES are presented to illustrate the invention more fully without any intention of being limited thereby. All parts and percentages are by weight unless otherwise indicated.

EXAMPLE 1

A sodium chlorite solution containing 2% by weight of $NaClO_2$, 20% by weight of NaCl, and containing dissolved $ClO_2$ at a temperature of 25° C., was passed through a photometric cell and the chlorite ion concentration measured and recorded on a photometer (previously calibrated from standard solutions) as a percent by weight of $NaClO_2$. The sodium chlorite solution was then fed to the anode compartment of an electrolytic cell having the anode separated from the cathode by a cation exchange membrane comprised of a perfluorosulfonic acid resin (Nafion® 227, E. I. DuPont de Nemours and Co.). Carbon electrodes were used as the anode and cathode, each being spaced apart from the other a distance of about 30 millimeters. A DC power supply fed electric current to the anode and through the sodium chlorite anolyte at a current density of 1.32 kiloamps per square meter. Chlorine dioxide gas was generated at the anode and dissolved in the anolyte to produce a chlorine dioxide-containing solution of sodium chlorite. The anode current efficiency was determined to be 84%.

EXAMPLES 2-5

Using the apparatus of EXAMPLE 1, solutions having measured concentrations of sodium chlorite containing dissolved $ClO_2$ were passed through the photometric cell and the visible light transmission (%) determined photometrically. The solutions were electrolyzed in the electrolytic cell of EXAMPLE 1 at a current density of 1.32 $KA/m^2$. The chlorine dioxide-containing solutions of sodium chlorite were removed from the anode compartment of the electrolytic cell. Air was blown through the solution at a rate of 1.2 liters per minute to recover the chlorine dioxide gas. Sodium chlorite solution concentrations, light transmission values and chlorine dioxide concentrations are given in TABLE 1 below.

TABLE 1

| Example No. | $NaClO_2$ conc. (% by weight) | Light Transmission (%) | $ClO_2$ in air conc. (% by volume) |
|---|---|---|---|
| 2 | 1.1 | 49 | 4.9 |
| 3 | 1.3 | 47 | 5.2 |
| 4 | 1.0 | 50 | 5.0 |
| 5 | 1.2 | 48 | 5.1 |

What is claimed is:

1. A continuous process for the production of chlorine dioxide by the electrolysis of an aqueous solution of sodium chlorite which comprises:

(a) feeding an aqueous solution of sodium chlorite to the anode compartment of an electrolytic cell;

(b) electrolyzing said aqueous solution of sodium chlorite in said anode compartment of the electrolytic cell to produce an aqueous solution of sodium chlorite containing dissolved chlorine dioxide;

(c) removing said aqueous solution of sodium chlorite containing dissolved chlorine dioxide having a pH of from about 5 to about 8 from said anode compartment;

(d) passing said aqueous solution of sodium chlorite containing dissolved chlorine dioxide through a photometric cell to measure the chlorite ion concentration; and (e) recovering chlorine dioxide gas from said aqueous solution.

2. The process of claim 1 in which said aqueous solution of sodium chlorite containing dissolved chlorine dioxide removed from said anode compartment has a chlorite ion concentration in the range of from about 0.8 to about 5 percent by weight.

3. The process of claim 2 in which said aqueous solution of sodium chlorite contains sodium chloride.

4. The process of claim 1 in which said sodium chlorite solutions containing dissolved chlorine dioxide transmit light in the range of from about 10 to about 60 percent.

5. The process of claim 2 in which said chlorine dioxide gas is recovered by passing an inert gas through said aqueous solution of sodium chlorite containing dissolved chlorine dioxide to produce a gaseous mixture containing chlorine dioxide.

6. The process of claim 5 in which the gaseous mixture containing chlorine dioxide is passed through a monitor to determine the concentration by volume of $ClO_2$.

7. The process of claim 3 in which said measured chlorite ion concentration is compared with a predetermined maximum value, when said measured chlorite ion concentration is equal to or less than said predetermined maximum value, adding sodium chlorite to said aqueous solution.

8. The process of claim 7 in which said predetermined maximum value is about 3 percent by weight of $NaClO_2$.

9. The process of claim 7 in which said sodium chlorite is added by contacting said aqueous solution of sodium chlorite with granular sodium chlorite particles.

10. The process of claim 7 in which said aqueous sodium chlorite solution containing dissolved chlorine dioxide removed from said anode compartment has a chlorite ion concentration in the range of from about 1 to about 3 percent.

11. The process of claim 10 in which said aqueous sodium chlorite solution containing dissolved chlorine dioxide has a pH of from about 7 to about 8.

12. A continuous process for the production of chlorine dioxide by the electrolysis of an aqueous solution of sodium chlorite which comprises:

(a) feeding an aqueous solution of sodium chlorite to the anode compartment of an electrolytic cell;

(b) electrolyzing said aqueous solution of sodium chlorite in said anode compartment to produce an aqueous solution of sodium chlorite containing dissolved chlorine dioxide;

(c) removing said aqueous solution of sodium chlorite containing dissolved chlorine dioxide from said anode compartment;

(d) measuring the visible light transmission of said aqueous solution of sodium chlorite containing dissolved chlorine dioxide; and (e) recovering chlorine dioxide gas from said aqueous solution of sodium chlorite; said electrolysis being operated to produce an aqueous solution of sodium chlorite containing dissolved chlorine dioxide having a visible light transmission in the range of from about 10 to about 60 percent.

13. The continuous process of claim 12 in which said aqueous solution of sodium chlorite containing dissolved chlorine dioxide from said anode compartment has a chlorite ion concentration in the range of from about 1 to about 3 percent by weight.

* * * * *